US006959876B2

(12) United States Patent
Chian et al.

(10) Patent No.: US 6,959,876 B2
(45) Date of Patent: Nov. 1, 2005

(54) METHOD AND APPARATUS FOR SAFETY SWITCH

(75) Inventors: Brent Chian, Plymouth, MN (US); Douglas D. Bird, Little Canada, MN (US)

(73) Assignee: Honeywell International Inc., Morristown, NJ (US)

( * ) Notice: Subject to any disclaimer, the term of this patent is extended or adjusted under 35 U.S.C. 154(b) by 107 days.

(21) Appl. No.: 10/424,257

(22) Filed: Apr. 25, 2003

(65) Prior Publication Data

US 2004/0211845 A1 Oct. 28, 2004

(51) Int. Cl.[7] ..... F23N 5/10
(52) U.S. Cl. ..... 236/68 D; 431/80
(58) Field of Search ..... 236/68 D; 136/217; 431/80, 82, 42

(56) References Cited

U.S. PATENT DOCUMENTS

| | | | | |
|---|---|---|---|---|
| 3,489,350 A | * | 1/1970 | Caparone | 236/68 D |
| RE30,936 E | | 5/1982 | Kmetz et al. | 431/22 |
| 4,696,639 A | | 9/1987 | Bohan, Jr. | 431/80 |
| 4,734,658 A | | 3/1988 | Bohan, Jr. | 331/117 R |
| 4,770,629 A | | 9/1988 | Bohan, Jr. | 431/80 |
| 4,834,284 A | | 5/1989 | Vandermeyden | 236/20 |
| 4,984,981 A | | 1/1991 | Pottebaum | 431/80 |
| 5,442,157 A | | 8/1995 | Jackson | 219/492 |
| 5,660,328 A | | 8/1997 | Momber | 236/20 R |
| 5,797,358 A | | 8/1998 | Brandt et al. | 122/448.1 |
| 6,059,195 A | | 5/2000 | Adams et al. | 236/20 |
| 6,261,087 B1 | | 7/2001 | Bird et al. | 431/80 |
| 6,293,471 B1 | | 9/2001 | Stettin et al. | 236/20 R |
| 6,701,874 B1 | * | 3/2004 | Schultz et al. | 431/80 |
| 2001/0031138 A1 | | 10/2001 | Troost, IV | |
| 2002/0132202 A1 | | 9/2002 | Clifford | 431/264 |

* cited by examiner

*Primary Examiner*—Harry B. Tanner
(74) *Attorney, Agent, or Firm*—Gregory M. Ansems

(57) ABSTRACT

A circuit in accordance with the invention includes a safety switch device coupled with, and between, a thermally activated voltage source and a primary switch. The circuit also includes a safety switch control circuit coupled with the safety switch device and a controller circuit; and a voltage generation circuit for turning on the safety switch device. The voltage generation circuit is coupled with the safety switch control circuit, the controller circuit and the safety switch device, such that the controller circuit substantially controls operation of the voltage generation circuit, the safety switch control circuit, and a primary switch circuit that includes the primary switch.

27 Claims, 2 Drawing Sheets

METHOD AND APPARATUS FOR SAFETY SWITCH

FIELD

The present invention relates to gas powered appliances and, more particularly, to gas-powered appliances with thermally powered control circuits.

BACKGROUND

Gas-powered appliances typically have some form of control system included for controlling the operation of the appliance. In this context, a gas-powered appliance may be a water heater, a fireplace insert or a furnace, as some examples. Also in this context, "gas-powered" typically means natural gas or liquid propane gas is used as a primary fuel source. Current control systems used in gas-powered appliances typically have some form of redundant shut-off mechanism, which may be termed a safety switch, in addition to a primary shut-off mechanism.

Such shut-off mechanisms typically take the form of a replicated electrical switch in series with a primary switch, where both the replicated and the primary switch are controlled by the same electrical control signal. A programmable controller, such as a micro-controller, may generate such electrical control signals, for example. In this regard, such approaches may not function as desired in the event of failure of the controller. For example, if the controller were to fail due to a latch-up condition, the controller may cause both the primary and redundant switch to close when it is desired to have one, or both switches open. Additionally, leakage current, due to moisture condensation or other factors, in a circuit that includes such switches may result in a sufficient voltage potential being generated to close the primary and/or redundant switch when it is desired to have one, or both of those switches open. Therefore, based on the foregoing, alternative approaches for implementing such safety switches may be desirable.

SUMMARY

A circuit in accordance with the invention includes a safety switch device coupled with, and between, a thermally activated voltage source and a primary switch. The circuit also includes a safety switch control circuit coupled with the safety switch device and a controller circuit and a voltage generation circuit for closing the safety switch device. The voltage generation circuit is coupled with the safety switch control circuit, the controller circuit and the safety switch device, such that the controller circuit substantially controls operation of the voltage generation circuit, the safety switch control circuit, and the primary switch circuit.

BRIEF DESCRIPTION OF THE DRAWINGS

The subject matter regarded as the invention is particularly pointed out and distinctly claimed in the concluding portion of the specification. The invention, however, as to both organization and method of operation, together with features and advantages thereof, may best be understood by reference to the following detailed description when read with the accompanying drawings in which:

DETAILED DESCRIPTION

In the following detailed description, numerous specific details are set forth in order to provide a thorough understanding of the invention. However, it will be understood that the present invention may be practiced without these specific details. In other instances, well-known methods, procedures, components and circuits have not been described in detail, so as not to obscure the present invention.

As was previously indicated, current approaches for control of gas-powered devices, such as appliances, may have certain drawbacks. Again, in this context, gas-powered typically means natural gas or liquid propane gas is employed as a primary fuel source. For the sake of illustration, the embodiments of the invention discussed herein will be described with reference to a water heater appliance. Of course, the invention is not limited in scope to use in a water heater, and other applications are possible. For example, embodiments of the invention may be employed in a gas-powered furnace, a gas-powered fireplace, or any number of other gas-powered devices.

Figure 1:
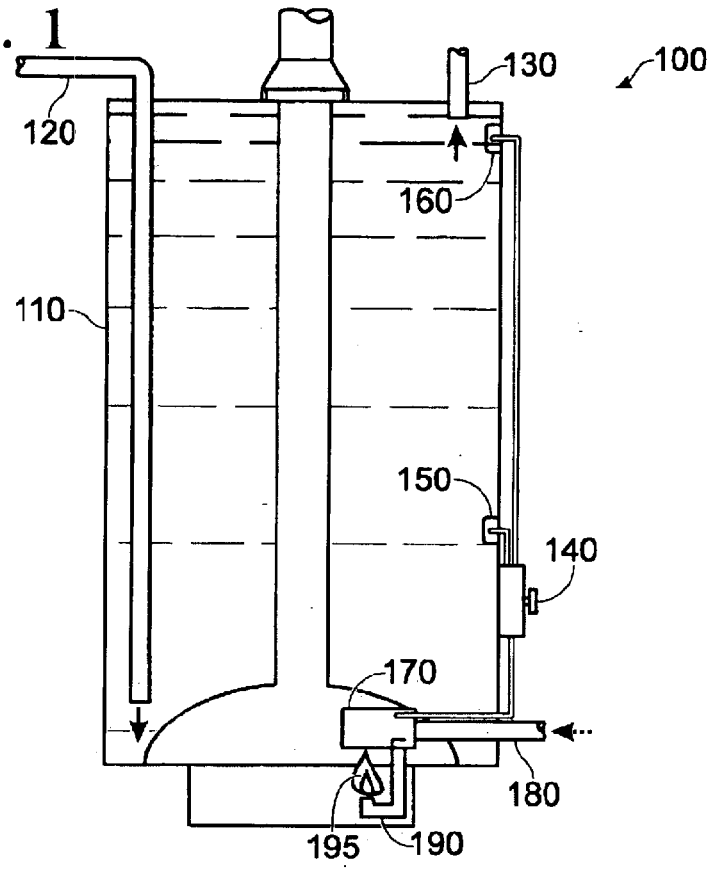
FIG. 1 is a drawing illustrating a water heater according to an embodiment of the invention.

Referring to FIG. 1, a drawing illustrating an embodiment of a water heater 100 in accordance with the invention is shown. Water heater 100 may include a storage tank 110 for storing water that has been, or is to be heated. Water heater 100 may also include a water supply feed pipe (typically cold water) 120, and a hot water exit pipe 130. Additionally, water heater 100 may include a selectable input device/control circuit 140, and temperature sensors 150 and 160. Information, such as water temperature within tank 110 and/or a preferred water temperature may be communicated, respectively, by temperature sensors 150 and 160 and the input device of input device/control circuit 140 to the control circuit of input device/control circuit 140. Typically, such information is communicated using electrical signals. In this regard, a thermo-electric device 170 may power input device/control circuit 140. While the invention while be described in further detail with respect to FIGS. 2–4, briefly, employing a thermally powered control circuit, such as input device/control circuit 140, with water heater 100 overcomes at least some of the foregoing described disadvantages, such as use of external power.

For water heater 100, a gas supply line 180 and a pilot burner/pilot gas valve 190 may also be coupled with input device/control circuit 140. In this regard, burner 190 may produce a pilot flame 195. Thermal energy supplied by pilot flame 195 may be converted to electric energy by thermo-electric device 170. This electrical energy may then be used by thermally powered input device/control circuit 140 to operate water heater 100, as is described in further detail hereinafter. Water heater 100 may further include a main burner/main burner gas valve (not shown), which may provide thermal energy for heating water contained within tank 110.

Figure 2:
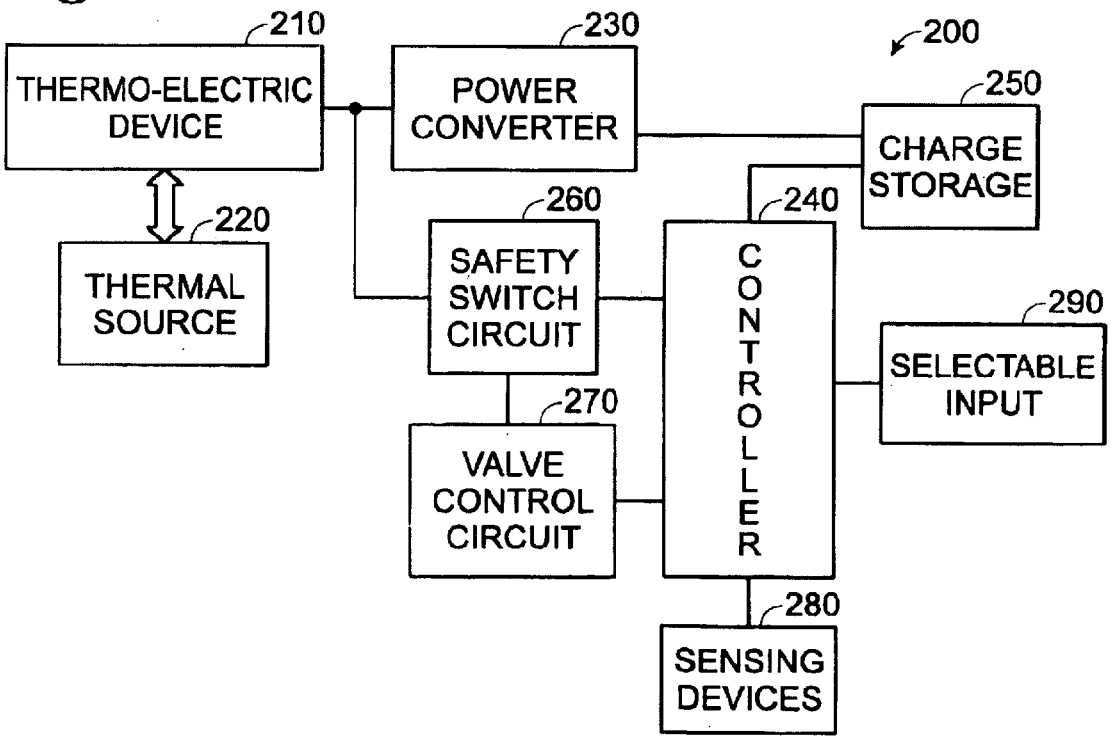
FIG. 2 is a block diagram of a thermally powered control circuit, including a safety switch, according to an embodiment of the invention.

Referring to FIG. 2, a block diagram of an embodiment of a thermally powered control circuit 200 in accordance with the invention is shown. Circuit 200 may be used in water heater 100 as control circuit 170, though the invention is not so limited. Features and aspects of the embodiment shown in FIG. 2 will be discussed briefly with reference to circuit 200, with a more detailed description of an embodiment of a safety switch circuit in accordance with the invention being set forth below with reference to FIGS. 3 and 4.

In this regard, circuit 200 may include a thermo-electric device 210 that is in thermal communication with a thermal source 220. In this context, thermal communication typically means that thermo-electric device 210 and thermal source 220 are in close enough physical proximity with each other, such that thermal energy generated by thermal source 220 may be absorbed by, or communicated to, thermo-electric device 210. In this respect, thermal energy communicated to thermo-electric device 210 from thermal source 220, in turn, may result in thermo-electric device 210 producing an electric voltage potential.

As is shown, thermo-electric device 210 may be coupled with power converter 230. Power converter 230 may modify the voltage potential produced by thermoelectric device 210. Typically, because the voltage potential produced by thermo-electric device 210 is lower than desired for operating most circuit components, power converter 230 may be a step-up power converter. Power converter 230 may be further coupled with a controller 240 and a charge storage device 250. While the invention is not limited in scope to the use of any particular controller, controller 240 may take the form of an ultra-low power microcontroller. Such microcontrollers are available from Texas Instruments, Inc., 12500 TI Boulevard, Dallas, Tex. 75243 as the MSP430 product family, though, as previously indicated, alternatives may exist. Charge storage device 250 may comprise circuit components, such as capacitors, for example, to store charge for use by controller 240, and also for stepping up the voltage potential generated by thermo-electric device 210.

Circuit 200 may also include a safety switch circuit 260 in accordance with the invention. Such safety switch circuits will be discussed in more detail below with reference to FIGS. 3 and 4. For circuit 200, safety switch circuit 260 may be coupled with thermoelectric device 210, power converter 230, controller 240, and a valve control circuit 270. For this particular embodiment, safety switch circuit 260 may shut any open gas valves associated with valve control circuit 270 as a result of controller 240 ceasing to toggle an output signal associated with safety switch circuit 260, which may indicate failure of controller 240. Additionally, controller 240 may include machine readable instructions that, when executed, may result in safety switch 260 shutting any open gas valves as part of a system shut down sequence. Valve control circuit 270 may be further coupled with controller 240, such that controller 240 may initiate opening and closing of one or more gas valves associated with valve control circuit 270, during normal operation of, for example, water heater 100. Methods that may be executed by controller 240 are described in commonly owned patent application No. 10/382,056, the entire disclosure of which is incorporated by reference herein.

Circuit 200 may still further include one or more sensing devices 280 and an input selection device 290, which may be coupled with controller 240. Sensing devices 280 may take the form of negative temperature coefficient (NTC) thermistors, which, for the embodiment illustrated in FIG. 1, may sense water temperature within storage tank 110. Controller 240 may then compare information received from sensing devices 280 with a threshold value that is based on a setting of selection device 290. Based on this comparison, controller 240 may initiate valve control circuit 270 to open a main burner valve to heat water within water heater 100. Alternatively, for example, controller 240 may initiate valve control circuit 270 to close a main burner valve to end a heating cycle in water heater 100. As was previously indicated, the invention is not limited to use with a water heater, and may be used in other applications, such as with furnaces or fireplaces. In such applications, sensing devices 280 may sense room temperature, as opposed to water temperature.

Figure 3:
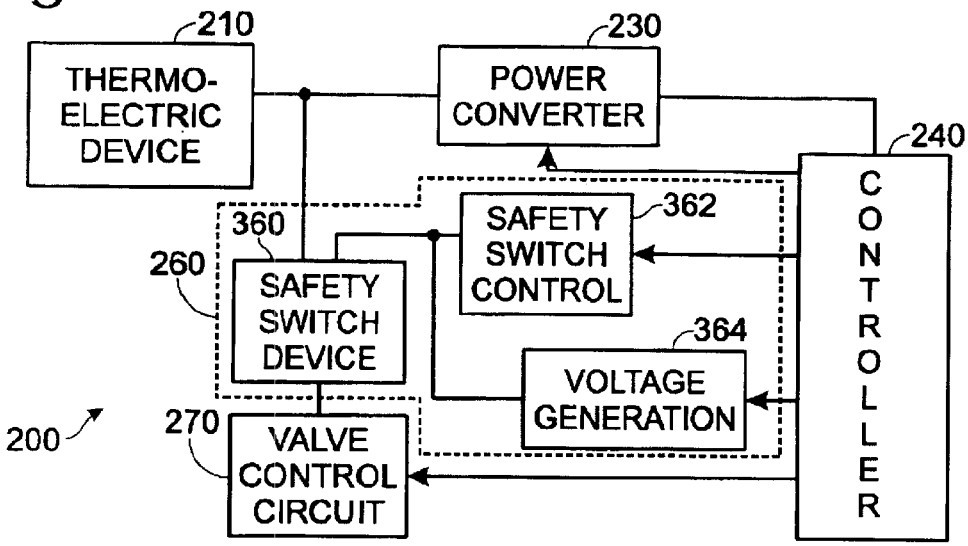
FIG. 3 is a more detailed block diagram of the circuit shown in FIG. 2.

Referring now to FIG. 3, another block diagram of circuit 200 showing safety switch circuit 260 in more detail is depicted. For ease of comparison, those blocks of circuit 200, as shown in FIG. 3, that correspond with blocks of circuit 200, as shown in FIG. 2, are indicated using the same reference numbers. As can be seen in FIG. 3, safety switch circuit 260 may comprise a safety switch device 360, a safety switch control circuit 362 and a voltage generation circuit 364. Each of these blocks is discussed in more detail with respect to FIG. 4. Briefly, however, voltage generation circuit 364 is coupled with safety switch device 360 and safety switch control 362 at a common circuit node. Safety switch device 360 is further coupled with thermo-electric device 210 and valve control circuit 270. Controller 240 is coupled with safety switch control 362, and voltage generation circuit 364. Such a configuration may allow safety switch device 360 to be turned off using safety switch control 362 and turned on using voltage generation circuit 364 based, at least in part, on electrical signals generated by controller 240. Additionally, for this embodiment, the voltage potential generated by thermo-electric device 210 may be communicated to valve control circuit 270 via safety switch device 360 when it is on.

Figure 4:
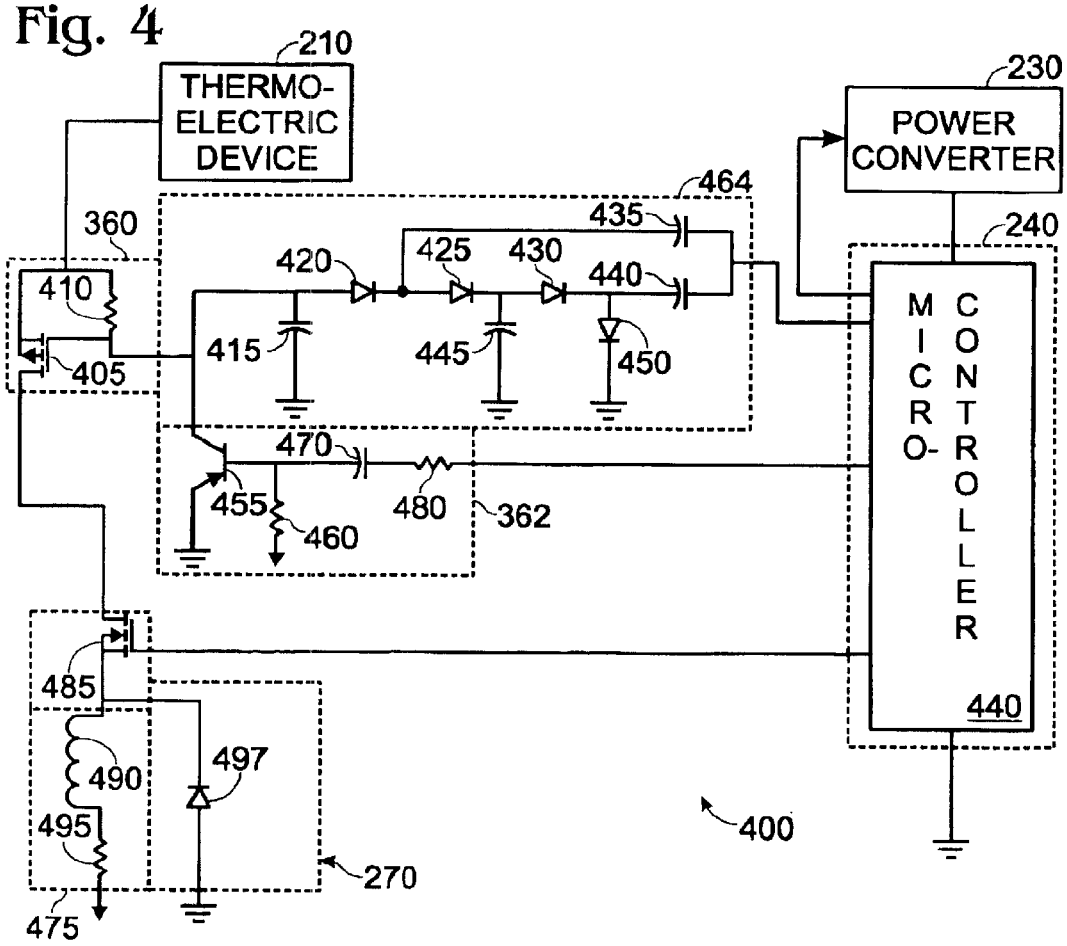
FIG. 4 is a schematic diagram illustrating a safety switch circuit according to an embodiment of the invention.

Referring now to FIG. 4, a schematic diagram of a control circuit 400 in accordance with the invention is shown. It is noted that circuit 400 is similar to circuit 200 depicted in FIGS. 2 and 3 in a certain respects. In this regard, the elements of circuit 400 that correspond with elements of circuit 200 have been designated with the same reference numbers. It will be appreciated, however, that the embodiments described herein are exemplary and the invention is not limited in scope to these particular embodiments.

Circuit 400 comprises a safety switch circuit that includes safety switch device 360, which is coupled with safety switch control circuit 362, voltage generation circuit 464 and valve control circuit 270. Circuit 400 further comprises controller 240, which, for this particular embodiment, takes the form of micro-controller 440. As was previously indicated, micro-controller 440 may be an ultra-low power micro-controller. Circuit 400, additionally comprises power converter 230, which may be a DC/DC converter including one or more stages. As is shown in FIG. 4, micro-controller 440 is coupled with power converter 230, valve control circuit 270, safety switch control circuit 362 and voltage generator 464, such that electrical signals generated by micro-controller 440 may be communicated to those circuits during operation of circuit 400. Such electrical signals, at least in part, may direct the operation of the above-indicated portions of circuit 400.

As shown in FIG. 4, safety switch device 360 may be coupled with, and between, thermo-electric device 210 and a valve driver 485 included in valve control circuit 270, which may also be termed a primary switch device. Valve driver 485, for this embodiment, comprises an n-type FET, which may be used to pick (fire) and hold a solenoid of a gas valve 475 for a gas powered appliance, such as water heater 100. In this regard, gas valve 475 comprises inductor 490 and resistor 495, which correspond, respectively, to the inductance and resistance of the solenoid of such a valve. Valve control circuit 270 also comprises free-wheeling diode 497, which may allow current stored in inductor 490 to "free-wheel" to electrical ground when either of, or both, safety switch device 360 and valve driver 485 are opened. It will be appreciated that multiple valve control circuits 270 may be coupled in such a fashion with safety switch device 360. For example, water heater 100 may include a pilot burner valve control circuit, such as for pilot burner 190 shown in FIG. 1, and a main burner gas valve control circuit, such as for a main gas burner (not shown).

For the particular embodiment illustrated in FIG. 4, safety switch device 360 may comprise a p-type FET 405. Of course, other switching devices may be used, including other types of semiconductor switch devices, for example. Safety switch device 360 may further comprise resistive element 410, which may discharge the gate of p-type FET 405 in certain situations to effect opening of safety switch device 360, as is discussed in more detail below.

For circuit 400, safety switch device 360 may be further coupled with safety switch control circuit 362, which, in turn, may be coupled with micro-controller 440. In this respect, micro-controller 440 may apply a positive voltage potential to safety switch control circuit 362. This applied voltage would charge a capacitor 470 via resistors 460 and 480, resulting in pnp-type transistor 455 being off while such a voltage is applied. Once capacitor 470 is charged, micro-controller 440 may apply electrical ground to safety switch control circuit 362, which would result in the voltage across capacitor 470 turning on pnp-type transistor 455. This would allow pnp-type transistor 455 to conduct and discharge the gate of p-type FET 405 and capacitor 415, causing safety switch device 360 to turn off. Turning off safety switch device 360 may result in gas valve 475 closing, regardless of the state of valve picking driver 485. Such a sequence of events may be the result of executing a series of machine executable instructions using micro-controller 440. For example, such a sequence may be part of a controlled shut down process and/or a user initiated diagnostic software routine for a gas-powered appliance.

Circuit 400 may further comprise a voltage generation circuit, as was previously discussed. For this embodiment, the voltage generation circuit takes the form of a charge pump circuit 464. Charge pump circuit 464 comprises diodes 420, 425, 430 and 450, and capacitors 415, 435, 440 and 445. Charge pump circuit 464 may be coupled with safety switch device 360, specifically the gate of p-type FET 405, and with micro-controller 440. Micro-controller 440 may pump charge pump circuit 464 by toggling an electrical signal between electrical ground and a positive voltage potential. In such a situation, a negative voltage potential may be applied to the gate of p-type FET 405 by charge pump circuit 464, resulting in safety switch device 360 being turned on. For this particular embodiment, the use of a p-type FET as part of safety switch device 360 may have certain advantages. In this regard, because the negative voltage produced by charge pump circuit 464 is typically the only negative DC voltage produced in circuit 400, parasitics, such as leakage, typically will not cause safety switch device 360 to close as a result of such parasitics.

Toggling such an electrical signal to pump charge pump circuit 464 may be achieved using machine executable instructions executed by micro-controller 440. For example, a main program loop of a control program being executed by micro-controller 440 may cause such an electrical signal to be transitioned to a positive voltage potential, while an interrupt service routine of such a control program may cause such an electrical signal to be transitioned to electrical ground. For such a scenario, should micro-controller 440 cease to execute either the main program loop, or the interrupt service routine, charge pump circuit 464, as a result, may not produce a negative voltage potential on the gate of p-type FET 405. Charge pump 464 not producing a negative voltage potential may then cause the gate of p-type FET 405 to discharge via resistive element 410, causing safety switch device 360 to turn off, which, in turn, would cause gas valve 475 to close. Because such a situation may occur due to failure of micro-controller 440, gas valve 475 closing may be a desirable outcome. Alternatively, ceasing to toggle such an electrical signal may also be part of a controlled shut down process and/or a user initiated diagnostic software routine for a gas-powered appliance, as was previously described.

As is also depicted in FIG. 4, valve driver 485 may be coupled with micro-controller 440. Micro-controller 440 may, for this configuration, control valve driver 485 by applying voltage to the gate of the n-type FET that valve driver 485 comprises. When safety switch device 360 is on, turning valve driver 485 on and off may cause gas valve 475 to, respectively, open and close. However, when safety switch device 360 is off, turning on and off valve driver 485 will typically not affect the state of gas valve 475, which would remain closed.

While certain features of the invention have been illustrated and described herein, many modifications, substitutions, changes and equivalents will now occur to those skilled in the art. It is, therefore, to be understood that the appended claims are intended to cover all such modifications and changes as fall within the true spirit of the invention.

What is claimed is:

1. A safety switch circuit comprising:

a safety switch device coupled with, and between, a thermally activated voltage source and a primary switch;

a safety switch control circuit coupled with the safety switch device and a controller circuit; and a voltage generation circuit for effecting turning on the safety switch device, the voltage generation circuit being coupled with the safety switch control circuit, the controller circuit and the safety switch device, wherein operation of the voltage generation circuit, the safety switch control circuit, and a primary switch circuit that comprises the primary switch is substantially controlled by the controller circuit.

2. The circuit of claim 1, wherein the safety switch device comprises a semiconductor switch device.

3. The circuit of claim 2, wherein the semiconductor switch device comprises a p-type field effect transistor.

4. The circuit of claim 2, wherein the safety switch device further comprises a discharge device to effect, at least in part, turning off the semiconductor switch device.

5. The circuit of claim 4, wherein the discharge device comprises a resistive element coupled with, and between, the thermally activated voltage source and a control terminal of the semiconductor switch device.

6. The circuit of claim 1, wherein the safety switch control circuit comprises:

a switched semiconductor device coupled with the safety switch device; and a charge storage circuit coupled with the switched semiconductor device and the controller circuit, wherein the charge storage circuit effects turning off and on the switched semiconductor device based, at least in part, on electrical signals generated by the controller circuit.

7. The circuit of claim 6, wherein effecting turning on the switched semiconductor device, in turn, results in effecting turning off the safety switch device.

8. The circuit of claim 6, wherein the switched semiconductor device comprises a pnp-type bipolar transistor.

9. The circuit of claim 8, wherein the charge storage circuit comprises a resistive-capacitive circuit coupled with, and between, a base of the pnp-type bipolar transistor and the controller circuit.

10. The circuit of claim 1, wherein the primary switch comprises a valve driver of a gas valve.

11. The circuit of claim 1, wherein the voltage generation circuit comprises a charge pump circuit, the charge pump circuit being coupled with the controller circuit so as to be pumped by electrical signals generated by the controller circuit.

12. The circuit of claim 11, wherein the charge pump circuit comprises a negative charge pump circuit.

13. A control circuit comprising:

a thermally activated power source;

a power converter coupled with the thermally activated power source;

a controller circuit coupled with the power converter;

a valve control circuit coupled with the controller circuit; and a safety switch circuit coupled with the thermally activated power source, the controller circuit, and the valve control circuit, wherein the safety switch circuit comprises:

a safety switch device coupled with, and between, the thermally activated power source and the valve control circuit;

a safety switch control circuit coupled with the safety switch device and the controller circuit; and a voltage generation circuit for turning on the safety switch device, the voltage generation circuit being coupled with the safety switch control circuit, the controller circuit and the safety switch device, wherein operation of the voltage generation circuit, the safety switch control circuit, and the valve control circuit is substantially controlled by the controller circuit.

14. The control circuit of claim 13, wherein the thermally activated power source comprises a thermopile device.

15. The control circuit of claim 14, wherein the thermopile device comprises two or more serially coupled thermocouple devices.

16. The control circuit of claim 13, wherein the power converter comprises one or more direct current to direct current voltage converters.

17. The control circuit of claim 13, wherein the controller circuit comprises an ultra-low-power microcontroller.

18. The control circuit of claim 13, wherein the valve control circuit comprises one or more valve drivers for actuating solenoids of one or more respective gas valves coupled with the valve control circuit in response to one more respective electrical signals generated by the controller circuit.

19. The control circuit of claim 13, wherein the safety switch device comprises a semiconductor switch device coupled with, and between, the thermally activated power source and the valve control circuit; and a discharge element coupled with, and between, a control terminal of the semiconductor switch device and the thermally activated power source.

20. The control circuit of claim 19, wherein the semiconductor switch device comprises a p-type field effect transistor and the control terminal comprises a gate of the p-type field effect transistor.

21. The control circuit of claim 13, wherein the safety switch control circuit comprises:

a bipolar junction transistor coupled with the safety switch device; and a resistive capacitive circuit coupled with a base of the bipolar junction transistor and the controller circuit, such that the resistive capacitive circuit effects turning on, and turning off, the bipolar transistor based, at least in part, on electrical signals generated by the controller circuit, wherein turning on the bipolar transistor results, at least in part, in turning off the safety switch device.

22. The control circuit of claim 13, wherein the voltage generation circuit comprises a negative voltage charge pump circuit coupled with the controller circuit so as to be pumped by electrical signals generated by the controller circuit, and the safety switch device comprises a p-type field effect transistor (FET), wherein the negative voltage charge pump is coupled with a gate of the p-type FET.

23. A method comprising:

applying thermal energy to a thermo-electric device;

generating a first voltage potential from the thermal energy using the thermoelectric device;

converting the first voltage potential to a second voltage potential using a power converter;

operating a controller circuit using the second voltage potential;

operating a voltage generation circuit using electrical signals generated by the controller circuit;

turning on a safety switch device using a voltage potential produced by the voltage generation circuit; and communicating the first voltage potential to a primary switch via the safety switch device.

24. The method of claim 23, wherein turning on the safety switch device comprises turning a semiconductor switch device on, so as to conduct current through the semiconductor switch device.

25. The method of claim 23, further comprising:

ceasing to operate the voltage generation circuit; and turning off the safety switch device via a discharge circuit.

26. The method of claim 25, wherein the discharge circuit comprises a passive circuit.

27. The method of claim 25, wherein the discharge circuit comprises a charge storage circuit coupled with the controller circuit, the charge storage circuit being coupled with a switched discharge device.

* * * * *